US006789966B2

(12) United States Patent
Tanaka et al.

(10) Patent No.: US 6,789,966 B2
(45) Date of Patent: Sep. 14, 2004

(54) PRINTER, CARRIAGE SUPPORTING STRUCTURE AND HEAD ASSEMBLY INCORPORATED IN THE PRINTER

(75) Inventors: Kazuo Tanaka, Nagano (JP); Kazuhiro Hashii, Nagano (JP); Hiromu Iida, Nagano (JP); Atsuhiko Takeuchi, Nagano (JP); Masaaki Kumasaka, Nagano (JP); Akira Sugino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/084,669

(22) Filed: Feb. 28, 2002

(65) Prior Publication Data

US 2002/0146266 A1 Oct. 10, 2002

(30) Foreign Application Priority Data

Feb. 28, 2001 (JP) ..... P2001-053325
May 28, 2001 (JP) ..... P2001-158161
May 29, 2001 (JP) ..... P2001-160916
May 29, 2001 (JP) ..... P2001-160917

(51) Int. Cl.[7] ..... B41J 25/308
(52) U.S. Cl. ..... 400/354; 400/59; 400/120.17; 347/198
(58) Field of Search ..... 400/55, 59, 120.16, 400/120.17, 352, 354; 347/8, 197, 198

(56) References Cited

U.S. PATENT DOCUMENTS 4,547,089 A * 10/1985 Jung et al. ..... 400/354
4,643,602 A * 2/1987 Ikeda et al. ..... 400/354
5,195,836 A * 3/1993 Longust et al. ..... 400/354
5,368,403 A * 11/1994 Broder et al. ..... 400/352
5,867,188 A * 2/1999 Murayama et al. ..... 347/37
6,109,726 A * 8/2000 Lee ..... 347/33
6,447,183 B2 * 9/2002 Ford ..... 400/320
6,520,622 B1 * 2/2003 Yusef et al. ..... 347/37

FOREIGN PATENT DOCUMENTS

JP 11-192719 7/1999

* cited by examiner

*Primary Examiner*—Andrew H. Hirshfeld
*Assistant Examiner*—Jill E. Culler
(74) *Attorney, Agent, or Firm*—Sughrue Mion, PLLC

(57) ABSTRACT

In a printer, in which printing is performed on a recording medium which is transported in a first direction, a carriage is reciprocately moved in a second direction which is perpendicular to the first direction. A print head is mounted on the carriage, and provided with a head face. A frame is placed in a first side of the print head. A guide plate extends in the second direction. The guide plate includes a first portion provided as a part of the frame so as to extend in a third direction which is orthogonal to both of the first direction and the second direction, a second portion continued from the first portion so as to extend in the first direction. The second portion supports the carriage so as to define a distance between the head face and the recording medium. The guide plate further includes a third portion continued from the second portion so as to extend in a fourth direction opposite to the third direction.

14 Claims, 13 Drawing Sheets

PRINTER, CARRIAGE SUPPORTING STRUCTURE AND HEAD ASSEMBLY INCORPORATED IN THE PRINTER

BACKGROUND OF THE INVENTION

The present invention is related to a printer which performs printing with a print head, a carriage supporting structure and a head assembly incorporated in the printer.

Generally speaking, in a printer, a printing operation is carried out by such a manner that either a carriage which mounts thereon a print head or a head assembly is relatively transported with respect to recording paper, while the head assembly is arranged by both a print head and a peripheral component thereof.

As disclosed in, for example, Japanese Patent Publication No. 11-192719A, a conventional carriage supporting structure for supporting and transporting a carriage mounted on such a printer employs such a structure that the carriage is supported on a carriage guide shaft so as to be transported. FIG. 1 is a side view showing the conventional carriage supporting structure with employment such a carriage guide shaft.

In FIG. 1, a carriage 51 comprises a bearing portion 64 in which a cylindrical-shaped hole is formed. A carriage guide shaft 65 made of a metal comprises a cylindrical shape which may be fitted to the hole of the bearing portion 64. The carriage 51 is supported by a carriage guide shaft 65 which is penetrated through the hole of the bearing portion 64.

The carriage 51 also has a belt receiving portion 63, while an endless belt (not shown) is fixed on this belt receiving portion 63. Then, drive force which is produced by rotations of a drive source such as a motor is transferred via this endless belt to the belt receiving portion 63, so that the carriage 51 is moved in the reciprocation manner along a main scanning direction.

Also, as described above, the carriage guide shaft 65 supports the carriage 51 in order that the carriage 51 can be moved in the reciprocation manner along the main scanning direction. Furthermore, this carriage guide shaft 65 regulates an interval between a print head 62 mounted on the carriage 51 and a recording surface of recording paper "P" which is transported while being slidably contacted to a platen 52. This interval is a so-called "paper gap" (will be simply referred to as a "gap" hereinafter).

On the other hand, while the carriage 51 has a guide portion 66, the carriage 51 is supported by this guide portion 66 with respect to a frame member 8 of the printer main body, so that a parallel degree of the head face of the print head 62 may be regulated.

As is well known in the art, the above-described gap "PG" may constitute the very important factor capable of greatly applying influences to printing qualities. Only when this gap "PG" is slightly changed from a defined gap value, the printing qualities would be largely changed. The conventional carriage supporting structure in which the carriage 51 is supported on the carriage guide shaft 65 comprises high gap precision, and thus, the gap "PG" is maintained substantially constant. Accordingly, there is a very small risk that the printing qualities are deteriorated since the gap "PG" is slightly changed from the defined gap value. As a consequence, very recently, this conventional carriage supporting structure could be widely employed even in printers capable of executing high-quality printing operations.

On the other hand, there is such a trend that printers are manufactured in lower cost. Considering price aspects of these low-cost printers, such an idea that carriage supporting structures manufactured in lower cost rather than such a carriage supporting structure constructed of the carriage guide shaft 65 are mounted on printers may effectively reduce resultant cost of these printers.

However, such a low-cost carriage supporting structure capable of maintaining the same level of the gap precision as that of the above-described conventional carriage supporting structure constituted by the carriage guide shaft 65 is not present in the carriage supporting structures known in this technical field.

Besides, in color printers, very high precision as to paper feeding mechanisms is necessarily required, so that these paper feeding mechanisms must be provided with complex constructions. In connection with these complex constructions, a total number of assembling steps for the respective components is also necessarily increased.

As a method capable of reducing total manufacturing steps, the following method has been considered. That is, while components are separately assembled to both a main frame and a sub-frame of a printer, these main frame and sub-frame are finally assembled to each other outside a printing area so as to reduce a total assembling step number of these components with respect to each of manufacturing lines for these frames, so that positional precision among these components may be increased.

However, in the case that such an assembling method is employed, an ink jet recording printer may have the following risk, while this ink jet recording printer requires a provision of a space (namely, home position) used for a maintenance purpose of a print head outside a printing area. That is, a carriage guide is flexed downwardly due to the own weight of the print head traveled to the home position side, so that a gap "PG" may be changed.

Furthermore, in such a printer that the print head 62 is mounted on the carriage 51, the travel precision and the response precision of the carriage 51 are adversely influenced, depending upon the assembling precision of these components. In particular, there is a risk that these adverse influences may cause more or less problems when image qualities of color printers are improved.

Furthermore, in such a case that this sort of carriage 51 must be replaced by new one, the following cumbersome works are necessarily required. That is, while the carriage 51 is dismounted from the carriage guide shaft 65 which has been previously dismounted from the printer main body, a new carriage 51 is penetrated thereto, and thereafter, this carriage guide shaft 65 should be assembled to the printer main body. In such a case that a play is produced between the print head 62 and the carriage 51, there is probability that the printing operation by the printer cannot be carried out under normal condition.

SUMMARY OF THE INVENTION

A first object of the present invention is to provide such a carriage supporting structure of a printer, while this carriage supporting structure can be made in low cost and can maintain a similar level of gap precision to that of a carriage supporting structure with employment of a carriage guide shaft.

A second object of the present invention is to provide a carriage supporting structure in which a gap is not changed due to the own weight of a print head, while a total number of manufacturing steps can be reduced.

A third object of the present invention is to provide such a head assembly capable of being a printer without employing a carriage, while superior drive operations and superior response characteristics can be maintained.

A fourth object of the present invention is to provide a head assembly capable of being mounted without dismounting a carriage guide shaft, and furthermore, capable of achieving high-precision printing operation.

A fifth object of the present invention is to provide such a printer equipped with the carriage supporting structure having the above-explained various merits.

A sixth object of the present invention is to provide a printer equipped with the head assembly having the above-described various merits.

In order to achieve the above objects, according to the present invention, there is provided a printer, in which printing is performed on a recording medium which is transported in a first direction, comprising:

- a carriage, reciprocately moved in a second direction which is perpendicular to the first direction;
- a print head, mounted on the carriage, the print head having a head face;
- a first frame, placed in a first side of the print head; and
- a first guide plate, extending in the second direction, which includes:
  - a first portion, provided as a part of the first frame so as to extend in a third direction which is orthogonal to both of the first direction and the second direction;
  - a second portion, continued from the first portion so as to extend in the first direction, the second portion supporting the carriage so as to define a distance between the head face and the recording medium; and
  - a third portion, continued from the second portion so as to extend in a fourth direction opposite to the third direction.

When one sheet of flat metal plate is bent by applying bending force to this metal plate along only one direction, this metal sheet may have two faces with different bending angles from each other. Such a metal plate will be flexed under such a condition that this metal plate is curved along a direction opposite to this bending direction. Therefore, subsequently, any one of these two faces is bent in such a manner that bending force is applied to this selected face along a direction opposite to that of the firstly-applied bending force, and thus, a sectional view of this face becomes a crank shape. As a result, a center face (above-described second portion) of the three faces which are formed by executing the above-explained two bending processes may become such a face having a very high flatness, since the flection of this plate which is caused by applying the bending force along two opposite directions is canceled.

It should be understood that the above-described crank-shaped bending process indicates such a condition that the flection caused by the bending process is canceled by applying the bending force along the opposite directions. As a consequence, this crank-shaped bending process may cover not only such a case that the angles of the first and third portions in the above-described structure with respect to the second portion are substantially equal to the right angle, but also may cover another case that these angles become acute angles, or obtuse angles.

As a consequence, the second portion for supporting the carriage as a so-called "gap defining face", namely the face for defining the distance between the head face of the print head and the recording surface of the recording paper corresponds to such a face having the high flatness, whose flection caused by the bending process may be canceled by applying thereto the bending force along the two opposite directions. As a result, the gap definition can be realized in high precision. Then, the first guide plate containing this second portion is arranged with the first frame in an integral manner, whereas the components of the carriage guide shaft mounting apparatus such as the carriage guide shaft and the bush can be reduced, so that the cost of this printer can be reduced. As a consequence, it is possible to provide such a low-cost carriage supporting structure with maintaining the same level of the gap precision as that of the carriage supporting structure constructed of the carriage guide shaft.

Preferably, the carriage is provided with a first guide member which is slid on a first face of the second portion of the first guide plate when the carriage moves in the second direction.

In accordance with this structure, even when the carriage is transported, the gap defined between the head face of the print head and the recording surface of the recording paper can be regulated in high precision.

Here, it is preferable that the first guide member is slid on a line situated at a substantially center of the second portion of the first guide plate in the first direction.

Since this position corresponds to such a portion having an especially high flatness within the second portion, and also, the first guide member is slidably contacted to this portion, the gap can be regulated in higher precision.

Preferably, either one of the first portion and the third portion of the first guide plate defines a position of the carriage in the first direction.

As previously described, the second portion of the first guide plate may become such a face having the very high flatness, the flection of which caused by the bending process is canceled by applying the bending force along the two opposite directions. Then, both the first portion and the third portion may become such faces having relatively high flatness, because of this very high flatness. Therefore, the position of the carriage along the first direction (namely, sub-scanning direction) can be defined in higher precision.

Here, it is preferable that the carriage is provided with a second guide member which grips either one of the first portion and the third portion of the first guide plate, so that the second guide member is slid thereon when the carriage moves in the second direction.

In accordance with this structure, the position of the carriage along the first direction can be defined in high precision.

Preferably, the carriage is provided with a third guide member which is slid on a second face of the second portion of the first guide plate when the carriage moves in the second direction. Here, the second face is an opposite face of the first face.

In accordance with this structure, since the first guide plate is sandwiched by both the first guide member and the third guide member, the position of the carriage along the third direction (namely, upper/lower directions) can be defined. As a consequence, it is possible to avoid such a phenomenon that the gap is changed due to vibrations applied to the carriage, and thus, the printing qualities are deteriorated.

Preferably, the printer further comprising:

- a second frame, placed in a second side of the print head which is opposite side of the first side;
- a second guide plate, extending in the second direction, which includes:
  - a fourth portion, provided as a part of the second frame so as to extend in the third direction;

a fifth portion, continued from the fourth portion so as to extend in the first direction, the fifth portion supporting the carriage so as to define the distance between the head face and the recording medium; and a sixth portion, continued from the fifth portion so as to extend in the fourth direction.

In accordance with this structure, since the gap is regulated by the two faces as to the second portion of the first guide plate and the fifth portion of the second guide plate, the parallel degree defined between the head face of the print head and the recording surface of the recording paper may also be regulated in addition to the gap.

Here, it is preferable that the carriage is provided with a fourth guide member which is slid on the fifth portion of the second guide plate when the carriage moves in the second direction.

In accordance with this structure, even when the carriage is moved, both the distance and the parallel degree between the head face of the print head and the recording surface of the recording paper can be regulated in high precision.

According to the present invention, there is also provided a printer, in which printing is performed on a recording medium which is transported in a first direction, comprising:

a carriage, on which a print head is mounted, reciprocately moved in a second direction which is perpendicular to the first direction;

a recording region, in which the print head performs printing;

a home position, provided in one of both sides of the recording region in the second direction, at which the carriage is placed when the print head does not perform printing;

a first frame, including:

a carriage guide, extending in the second direction from the recording region to the home position such that the carriage moves therealong; and supporting legs, extending downwards from both side end portions of the carriage guide; and a second frame, including:

first positioning members, which define positions of the supporting legs in the first direction;

second positioning members, which define positions of the supporting legs in the second direction;

third positioning members, which define positions of the supporting legs in a third direction which is orthogonal to both of the first direction and the second direction; and a supporting base, which supports at least a bottom portion of one supporting leg situated in the home position.

In accordance with this structure, even when the respective components are independently assembled to the different frame members of the printer, since these frames are positioned with respect to the main scanning direction, the sub-scanning direction, and the upper/lower direction (namely, first to third directions respectively), not only the positioning precision among these components can be maintained in high degrees, but also the printing precision achieved by the print head can be maintained in high degrees even in such a type of printer that the print head is moved to the home position side for maintenance purpose. That is, since the carriage guide projected to the home position side is supported by the supporting base, such a phenomenon that the carriage guide is flexed downwardly due to the own weight of this print head can be suppressed, and also the gap can be continuously and correctly held.

According to the present invention, there is also provided a printer, in which printing is performed on a recording medium which is transported in a first direction, comprising:

a first guide plate, extending in a second direction which is perpendicular to the first direction;

a looped belt member;

a drive motor, which circulating the looped belt member in the second direction;

a head assembly, including:

a print head;

a belt holder, at which a part of the looped belt is fixed; and a first guided portion, provided in a first side of the print head, and slid on the first guide plate in accordance with the circulation of the looped belt member.

In accordance with this structure, since the head assembly can be mounted on the printer without using the carriage, not only the structure of this head assembly can be made simple, but also there is no play produced among the components. Therefore, the drive characteristic of the head assembly can be largely improved, and furthermore, the response characteristic thereof can be extremely improved.

Preferably, the printer further comprises a second guide plate placed in a second side of the print head, which is an opposite side of the first side, so as to extend in the second direction. Here, the head assembly includes a second guided portion slid on the second guide plate in accordance with the circulation of the looped guide member.

In accordance with this structure, the head assembly can be supported under more stable condition.

Preferably, the first guided member is slidably held on the first guide plate while defining a position of the print head in the first direction. Here, the head assembly includes a third guided portion slidably held on the first guide plate while defining a position of the print head in a third direction which is orthogonal to both of the first direction and the second direction.

In accordance with this structure, such a cumbersome work is no longer required. That is, the carriage guide shaft and the like are dismounted from the printer main body. Moreover, the print head itself can be assembled on the carriage guide plate. As a consequence, the works for assembling the print head to the printer main body can be largely made simple, and at the same time, the scanning precision thereof can be extremely improved. In addition, a total number of these structural components can be greatly reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to drawings, various preferred embodiments of the present invention will be described in detail.

Figure 1:
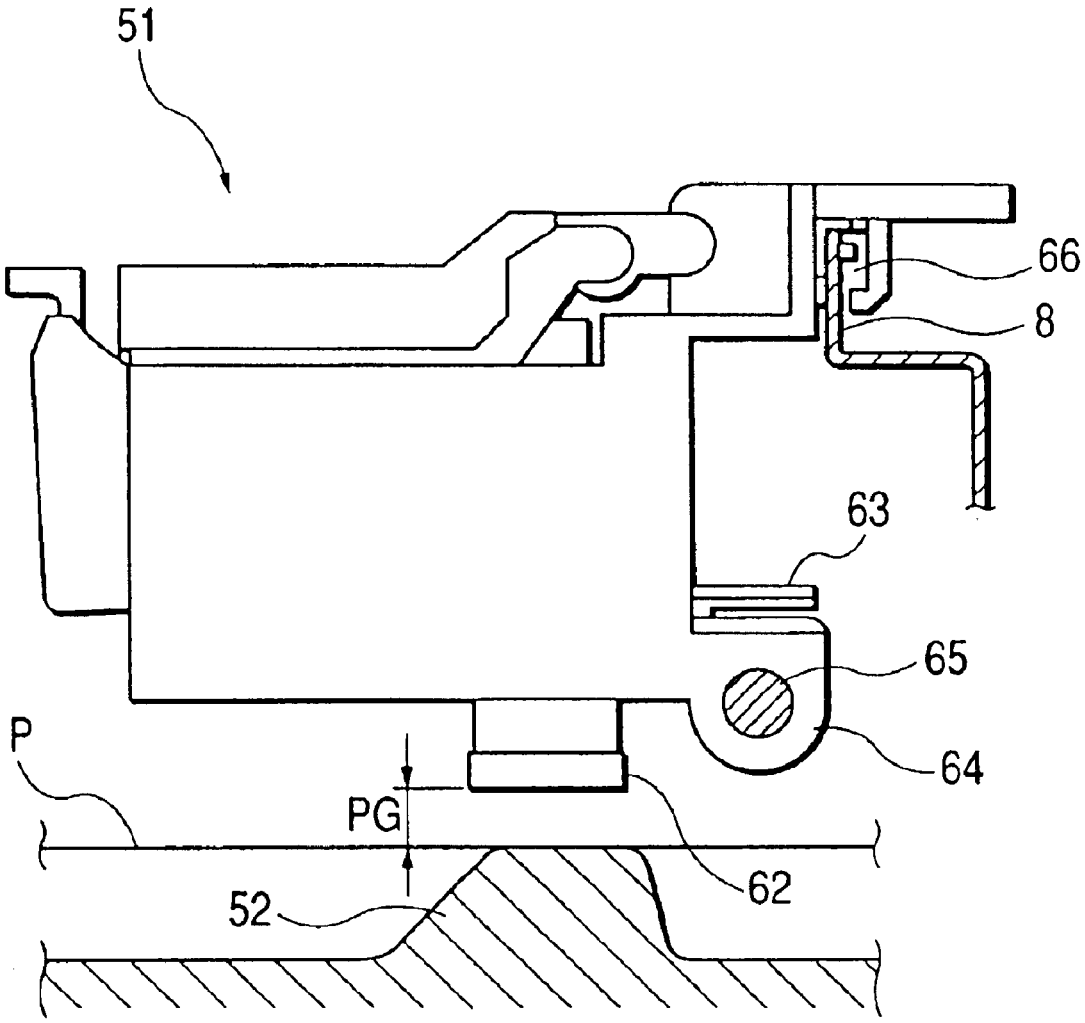
Related Art FIG. 1
FIG. 1 is a side view showing one example of a conventional carriage supporting structure using a carriage guide shaft.
Figure 2:
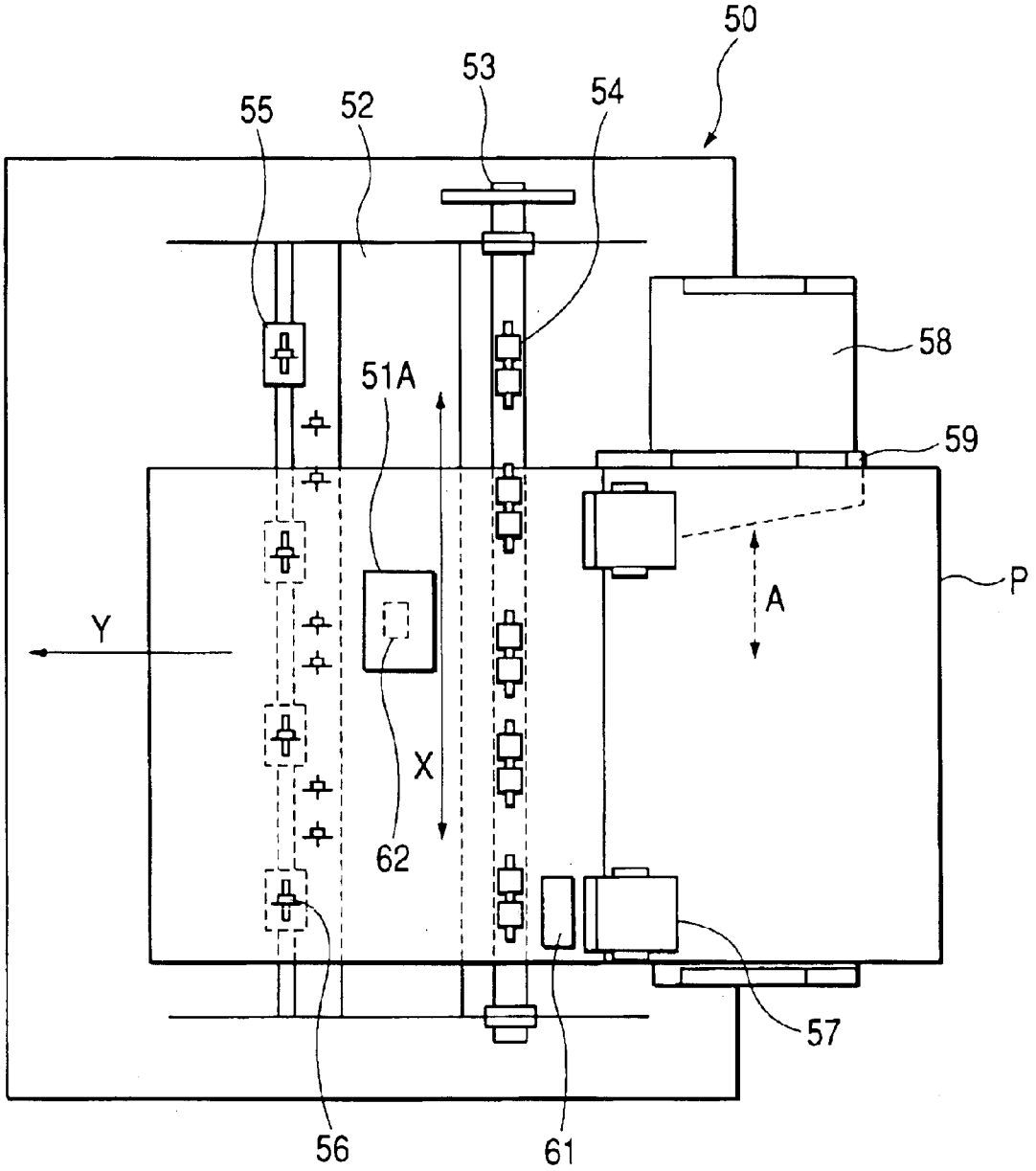
FIG. 2 is a schematic plan view showing an ink jet printer incorporating a carriage supporting structure according to a first embodiment of the present invention.
Figure 3:
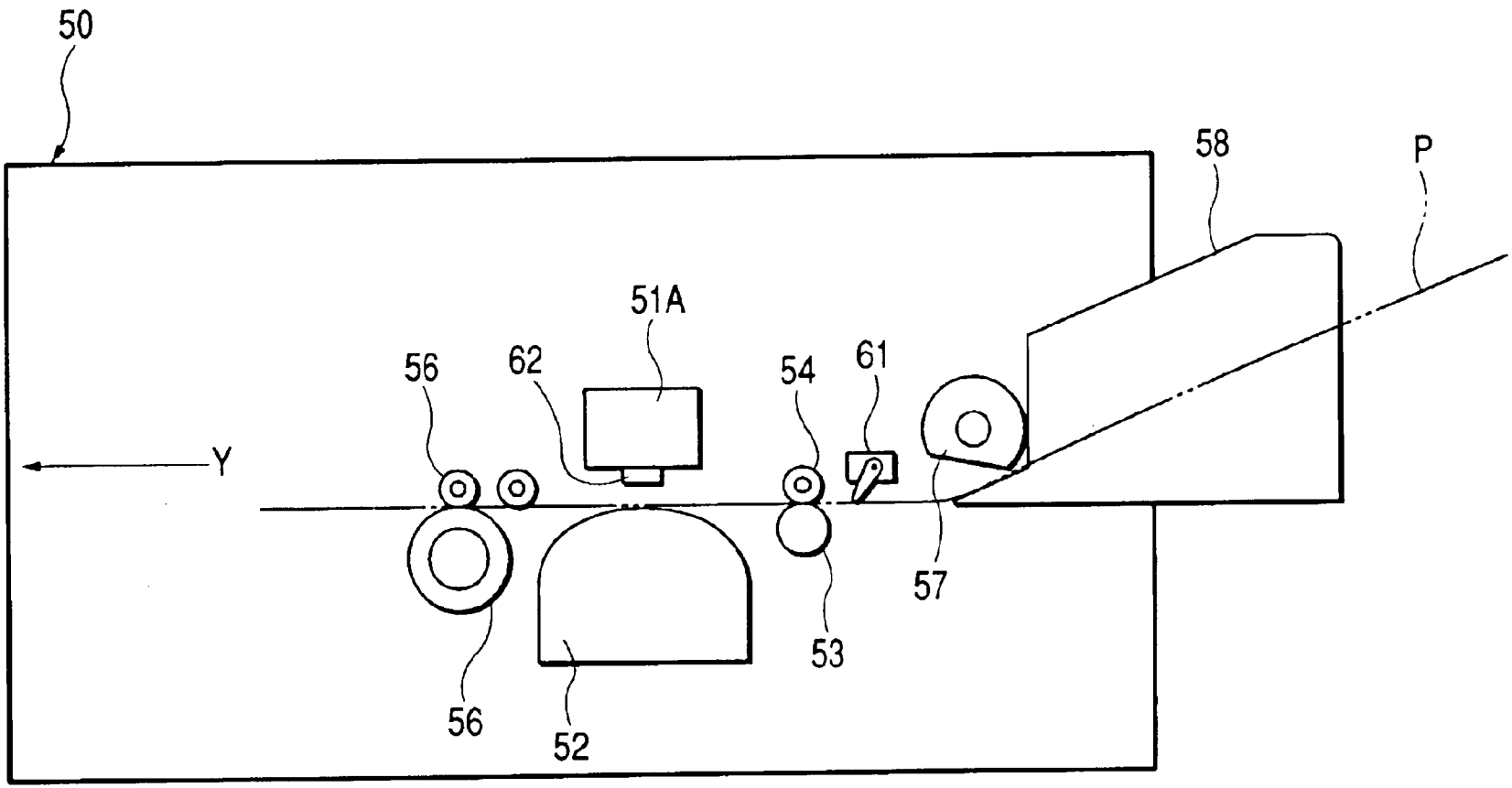
FIG. 3 is a schematic side view showing the printer shown in FIG. 2.

FIG. 2 is a plan view for schematically showing an ink jet printer which mounts thereon a carriage supporting structure according to a first embodiment of the present invention, and FIG. 3 is a side view for schematically showing this printer.

As indicated in FIG. 2 and FIG. 3, in this ink jet printer 50, a carriage 51A is provided. The carriage 51A is moved, or transported along a main scanning direction "X" in order to perform a printing operation on recording paper "P." A print head 62 is mounted on the carriage 51A, while the print head 62 jets ink droplets on the recording paper P so as to perform the printing operation. A platen 52 is provided opposite to the print head 62. The platen 52 may define a gap between a head face of the print head 62 and the recording paper P. Then, while the carriage 51A is transported along the main scanning direction X, and the recording paper P is transported between this carriage 51A and the platen 52 in an intermittent manner along a sub-scanning direction "Y", the print head 62 jets the ink droplets on the recording paper P so as to execute the printing operation on the recording paper P.

A paper supply tray 58 is constructed in such a manner that this paper supply tray 58 can supply such recording paper "P" as, for example, normal paper and photosensitive paper. An automatic sheet feeder (ASF) is provided with this paper supply tray 58 in order to automatically supply the recording paper P. The ASF corresponds to an automatic paper supply mechanism, which contains two supply rollers 57 provided with the paper tray, and a separation pad (not shown). The rotations of the supply rollers 57 are controlled by receiving drive force produced by rotations of a motor such as a stepping motor, while these supply rollers 57 have "D"-shaped outer shapes, as viewed from a side thereof.

One roller of these two supply rollers 57 is arranged on one side of this paper supply tray 58, whereas the other roller is mounted on a recording paper guide 59. The recording paper guide 59 is provided on the paper supply tray 58 in such a manner that this recording paper guide 59 can be slid along an arrow direction indicated by a symbol "A" in connection to the width of recording paper P. Then, when plural sheets of the recording paper P set on the paper supply tray 58 are supplied, these plural sheets of recording paper P are not supplied one time, but can be automatically and correctly supplied one by one, because of both the rotation drive force of the supply rollers 57 and friction resistance of the separation pad.

The recording paper P which is automatically supplied by the ASF is transported by a predetermined paper feed amount in an intermittent manner along a downstream side of the sub-scanning direction "Y" by way of a recording paper transporter which is arranged on the downstream side of the sub-scanning direction Y from the supply rollers 57. This downstream side constitutes a print execution area side.

As the recording paper transporter for transporting the recording paper P in the intermittent manner along the sub-scanning direction Y, both a transport driving roller 53 and a transport follower roller 54 are provided. While the rotation of this transport driving roller 53 is controlled by way of the rotation drive force of the motor such as the stepping motor, the recording paper P is transported along the sub-scanning direction Y by rotating the transport driving roller 53. While plural sets of the transport follower rollers 54 are provided, these transport follower rollers 54 may be independently rotated. The transport driving roller 53 is made in contact with each of these transport follower rollers 54 under application of pressure. When the recording paper P is sandwiched between the transport driving roller 53 and each of the transport follower rollers 54, the respective transport follower rollers 54 are rotated by rotating the transport driving roller 53 in the follower manner as to the transport of this recording paper P while these transport follower rollers 54 are made in contact with this recording paper P.

Also, a paper detector 61 using the well-known technique is arranged between the supply roller 57 and the transport driving roller 53. While the paper detector 61 comprises a lever, this lever is urged by an urging member (not shown) in such a manner that this lever itself may be automatically returned to a standing position along a vertical direction. Furthermore, the lever is pivotally supported in such a way that this lever can be pivoted only along the sub-scanning direction Y which corresponds to the recording paper transport direction under such a condition that this lever is projected within a transporting path for the recording paper P. The paper detector 61 is turned ON when a tip portion of this lever is pushed by the recording paper P so that the lever is pivoted, whereas the paper detector 61 is turned OFF when the lever is returned to the original standing position thereof. The paper detector 61 may detect both an initial edge position and an termination edge position of the recording paper P supplied by the supply roller 57 by these ON/OFF operations thereof. A printer 50 determines a recording area of the recording paper P in correspondence with both the initial edge position and the termination edge position of the recording paper P, which are detected by the paper detector 61, and then, performs a printing operation with respect to the recording paper P.

As ejector for a recording paper "P" on which the printing operation has been performed by the printer 50, both an ejection driving roller 55 and an ejection follower roller 56 are provided. The rotation of the ejection driving roller 55 is controlled by the rotation drive force of the motor such as the stepping motor. Since the ejection driving roller 55 is rotated, the recording paper P is ejected along the sub-scanning direction Y. The ejection follower roller 56 comprises a plurality of teeth around an outer peripheral surface thereof. A tip portion of each tooth is narrowed and is to be made in a pint contact with a recording surface of the recording paper P. A plurality of ejection follower rollers 56 may be rotated independently. When the recording paper P is sandwiched between the ejection driving roller 55 and each of the ejection follower rollers 56, the respective ejection follower rollers 56 are rotated by rotating the ejection driving roller 55 in the follower manner as to the ejection of this recording paper P while these ejection follower rollers 56 are made in contact with this recording paper P.

In such a printer 50, the carriage 51A which mounts thereon the print head 62 can be move in a reciprocation manner along the main scanning direction "X" by way of the carriage supporting structure according to the first embodiment of the present invention. The carriage 51A is regulated by the carriage supporting structure in such a manner that a gap "PG" (see FIG. 4) always becomes a constant interval while the carriage 5 IA is moved in the reciprocation manner along the main scanning direction "X." This gap "PG" corresponds to such an interval defined between the head face of the print head 62 and the recording surface of the recording paper P, while this recording paper P is transported along the sub-scanning direction Y with being slidably contacted with the platen 52.

Figure 4:
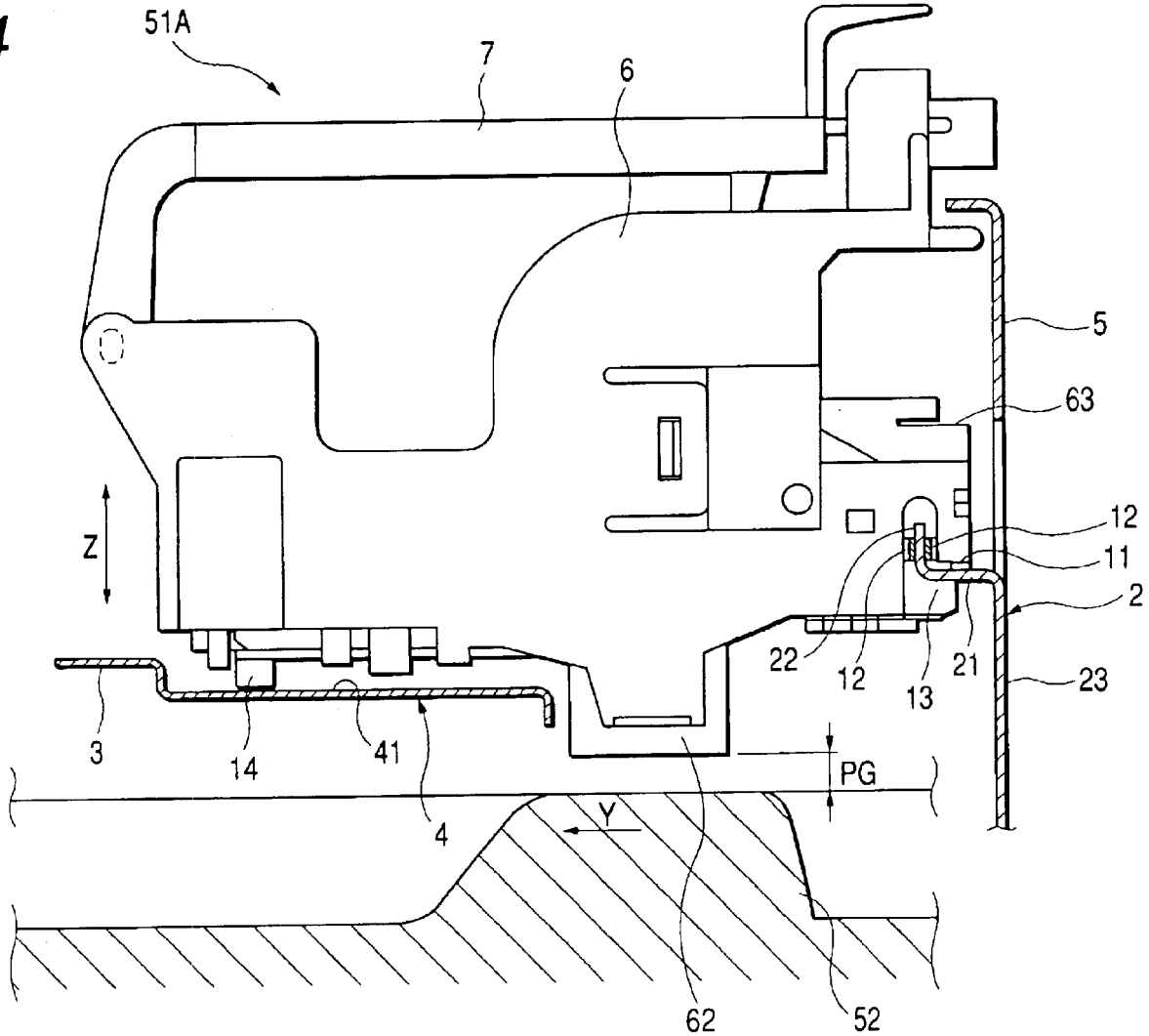
FIG. 4 is a side view showing the carriage supporting structure of the printer shown in FIG. 2.
Figure 5:
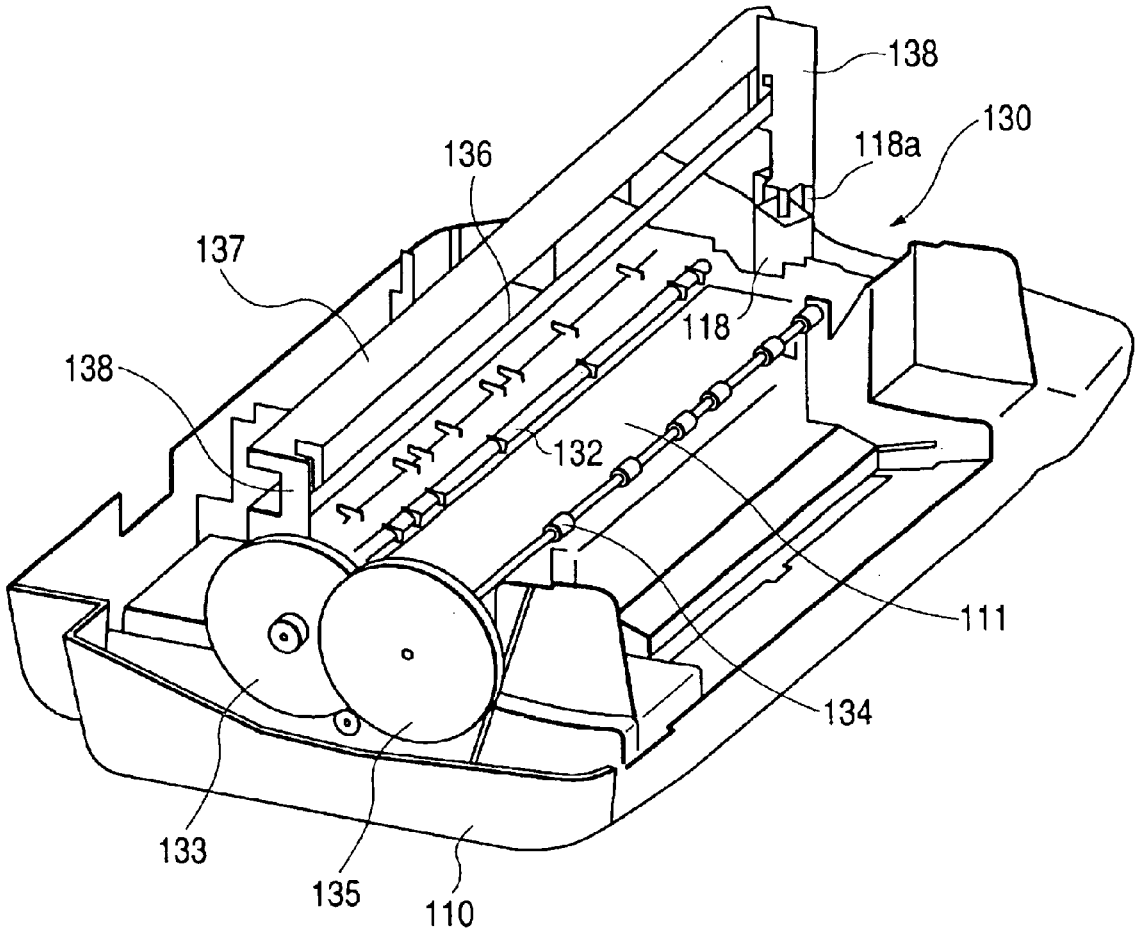
FIG. 5 is a perspective view showing a main body of a printer incorporating a carriage supporting structure according to a second embodiment of the present invention.
Figure 6:
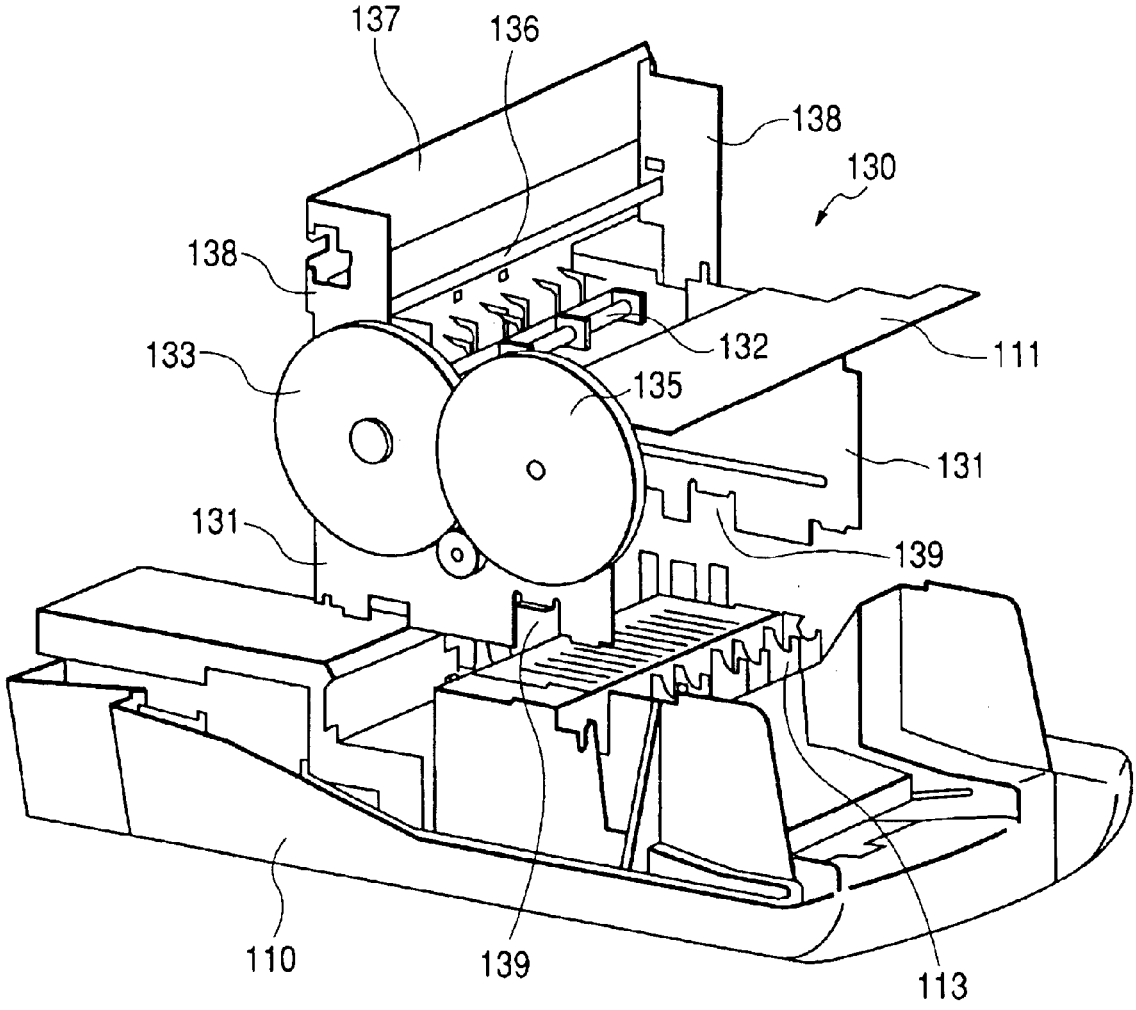
FIG. 6 is a perspective view showing a condition of an assembling stage as to a main body of the printer shown in FIG. 5.

FIG. 4 is a side view for showing the carriage supporting structure according to the first embodiment.

As indicated in FIG. 4, the carriage 51A is constituted by a carriage main body 6 and also a cover portion 7. The print head 62 is mounted on a bottom portion of the carriage main body 6. Also, while various sorts of ink cartridges (not shown) are mounted inside of the carriage main body 6, ink stored in these ink cartridges is jetted from the print head 62 to the recording paper P in the form of ink droplets. An endless belt (not shown) is fixed on a belt receiving portion 63 which is formed on the carriage 51A. Since driving force produced from rotation drive force such as a motor is transferred via this endless belt to the belt receiving portion 63, the carriage 51A may be moved along the main scanning direction "X" in the reciprocation manner.

A first carriage guide plate 2 is arranged on the main frame 5 of the printer 50 in an integral manner. The first carriage guide plate 2 is bent so as to have a crank-shaped sectional view, and forms three faces 21, 22, and 23, which are elongated in parallel to the main scanning direction "X." Among these faces, the face 21 constitutes a first position regulating face 21 which regulates the gap "PG" to support the carriage 51.

This first position regulating face 21 corresponds to such a face having a high flatness, in which the flection caused by the bending process by applying thereto bending force along two opposite directions, is canceled. Then, since the first guide portion 11 formed on the carriage 51A is slidably contacted to this first position regulating face 21 so as to regulate the gap "PG", high-precision regulation of the gap "PG" can be realized. It should be noted that the first guide portion 11 is slidably contacted to the first position regulating face 21 in the vicinity of a position on a center line thereof along the sub-scanning direction Y. This position corresponds to a portion having the highest flatness within the first position regulating face 21. Since the first guide portion 11 is slidably contacted to this portion, the gap "PG" can be regulated with higher precision.

The two faces which are formed in the first carriage guide plate 2 and are located adjacent to the first position regulating face 21 have high flatness similar to that of the first position regulating face 21. One of these two faces constitutes the second position regulating face 22 for regulating the position of the carriage 51A along the sub-scanning direction Y. Then, since the second position regulating face 22 is sandwiched by the second guide portion 12 provided on the carriage 51A, the position of the carriage 51A along the sub-scanning direction Y may be regulated. As a result, deteriorations of printing qualities caused by such a fact that the attitude of the print head 62 is inclined along the sub-scanning direction can be prevented. It should be noted that another face indicated by symbol 23 may be apparently used as the second position regulating face, and thus, a similar effect may be achieved.

Also, a third guide portion 13 is provided on the carriage 51A. As indicated in this drawing, the third guide portion 13 is provided at a position opposite to the first guide portion 11, while sandwiching the first position regulating face 21. Then, under such a condition that both the first guide portion 11 and the third guide portion 13 sandwich the first position regulating face 21, the carriage 51A is supported on the first position regulating face 21. As a result, with respect to the carriage 51, the gap "PG" may be regulated by the first position regulating face 21 having the high flatness, and furthermore, a positional regulation along upper/lower directions shown by symbol "Z" may be carried out by this first position regulating face 21, so that the gap "PG" can be regulated in higher precision.

On the other hand, a second carriage guide plate 4 is formed in an integral form on an ejection frame 3 where the ejection follower rollers 56 are arranged. The second carriage guide plate 4 is bent so as to have a crank-shaped sectional view, and forms three faces which are elongated in parallel to the main scanning direction "X." Among these faces, the face 41 constitutes a third position regulating face 41 which regulates the gap "PG" of the carriage 51 to support this carriage 51 in conjunction with the first position regulating face 21.

Similar to the first position regulating face 21, this third position regulating face 41 corresponds to such a face having a high flatness, in which the flection caused by the bending process by applying thereto bending force along two opposite directions is canceled. Then, the fourth guide portion 14 provided on the carriage 51A is slidably contacted to this third position regulating face 41, so that the gap "PG" may be regulated.

As a consequence, in the carriage 51A, since the gap "PG" is regulated by the first position regulating face 21, the third position regulating face 41, and two sets of the position regulating faces having the high flatness, the higher precision regulation of this gap "PG" can be realized. Then, as indicated in the drawing, since both the first guide portion 11 and the fourth guide portion 14 are provided on both the upper stream side and the lower stream side of the sub-scanning direction "Y" respectively, while sandwiching the print head 62, the carriage 51A can be supported under more stable condition, and also, a parallel degree of the head faces of the print head 62 may be regulated in high precision.

As previously described in detail, in accordance with the carriage supporting structure of this first embodiment, the carriage 51 can be supported by both the first carriage guide plate 2 and the second carriage guide plate 4, while regulating the gap "PG" in high precision.

Alternatively, as a modification of this first embodiment, such a carriage supporting structure may be conceived in which the second carriage guide plate 4 is not provided; Also, in this alternative case, the present invention may be embodied, and therefore, a similar effect to that of the first embodiment may be achieved.

Referring now to FIG. 5 to FIG. 8, a description is made of a second embodiment of the present invention.

This printer main body is arranged by a main frame 110 which constitutes a lower portion of a housing, and a sub-frame 130 which is mounted on this main frame 110 at a predetermined position.

In the main frame 110, both a supply roller bearing (not shown) and an ejection roller bearing 113 are formed in an integral form on both the paper supply side and the paper ejection side. Also, a flat platen 111 is assembled in this main frame 110 at a center thereof. Furthermore, positioning members 115, 116, and 117 (will be discussed later) are formed on both outside portions of a printing area in an integral manner, while these positioning members 115, 116, and 117 are employed so as to hold supporting legs 131 along the main scanning direction X, the sub-scanning direction Y, and the upper/lower direction Z. The plate-shaped supporting legs 131 are suspended from both edges of the sub-frame 130.

On the other hand, in the sub-frame 130, both a supply roller 132 and an ejection roller 134, on which both a supply roller gear 133 and an ejection roller gear 135 are fixed respectively, are assembled on one edge of this sub-frame 130. Furthermore, two sets of carriage guides 136 and 137 are assembled via the supporting legs 138 of both edges in this sub-frame 130, while these carriage guides 136 and 137 may guide the print head along the main scanning direction X.

Figure 7:
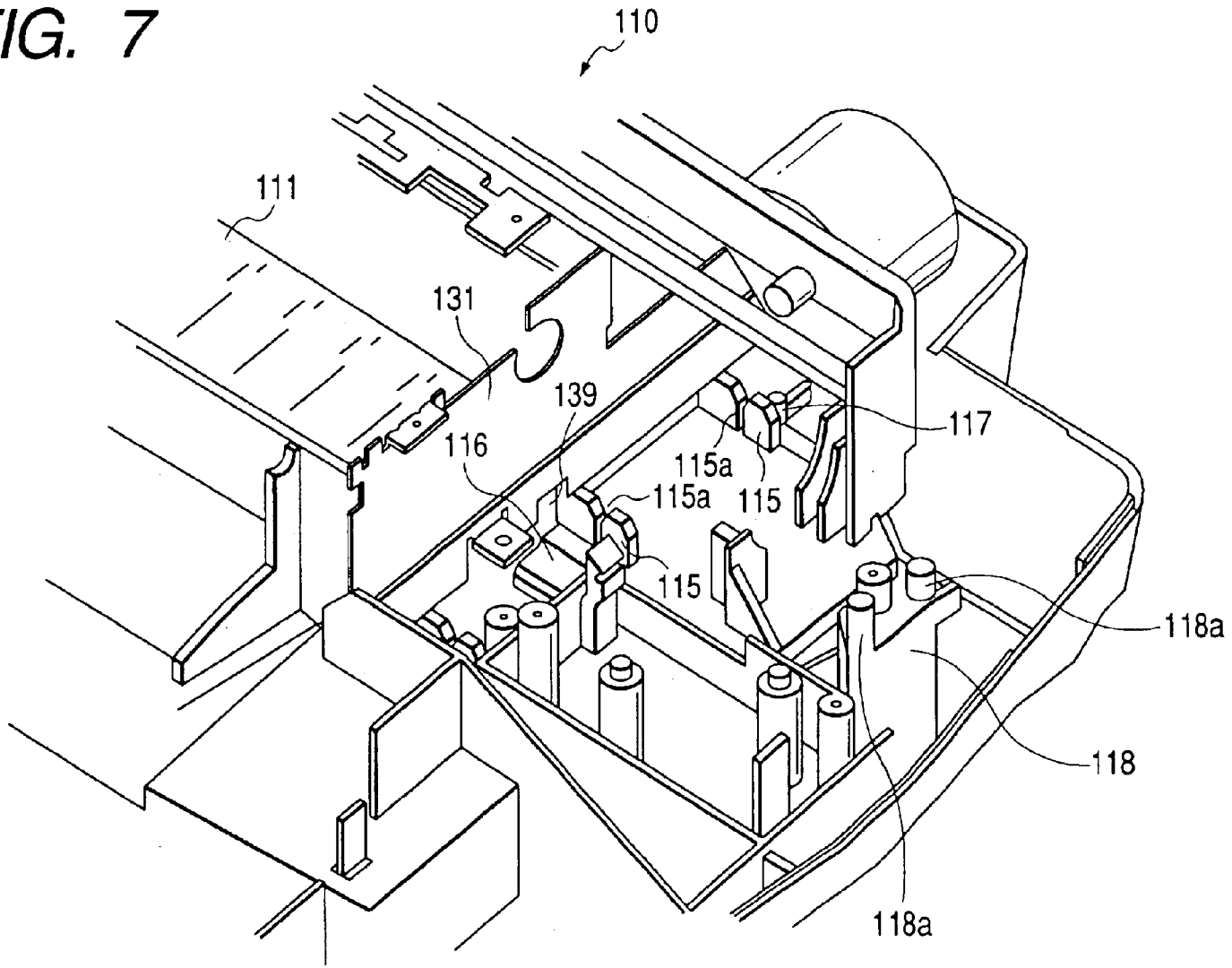
FIG. 7 is a perspective view showing a home position side of a main frame of the printer main body shown in FIG. 5.

Several sets X-direction positioning members 115 stand as projections equipped with slits 115*a* on the home position side outside the printing area of the main frame shown in FIG. 7. These X-direction positioning members 115 may position the sub-frame 130 along the main scanning direction X, namely a printing column direction, while the supporting legs 131 of the sub-frame 130 are inserted thereinto.

Figure 8:
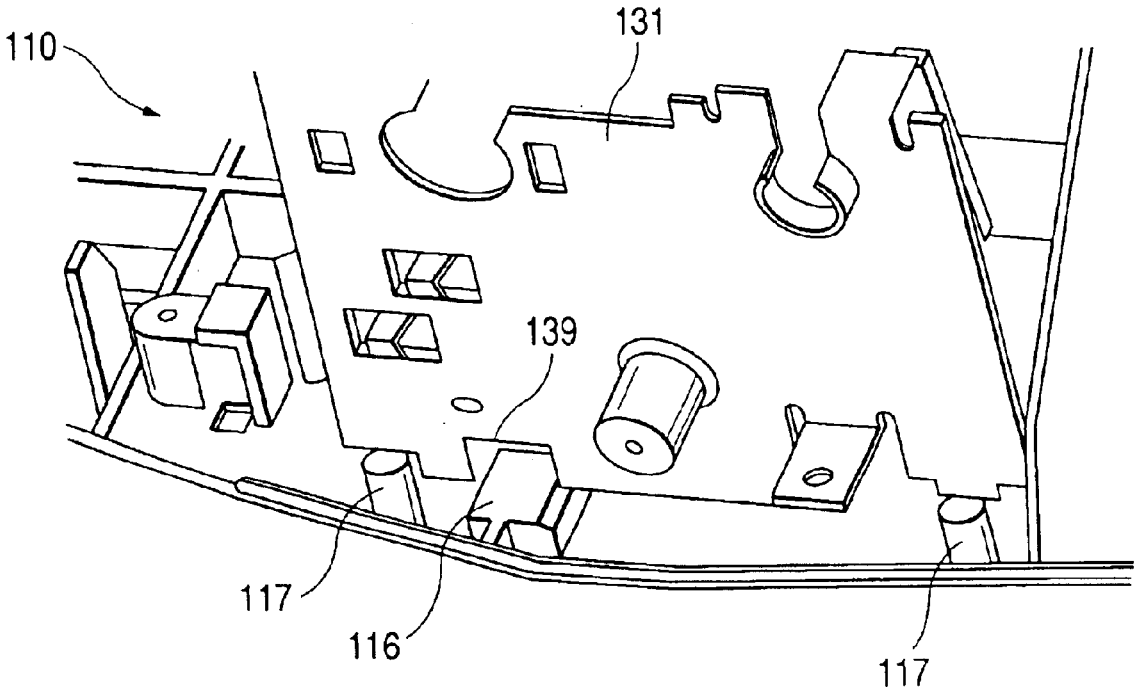
FIG. 8 is a perspective view showing a print terminal side of the printer main body shown in FIG. 5.

Also, a Y-direction positioning member 116 and a Z-direction positioning member 117 are made stood on the side of the home position and on the side of a printing terminal shown in FIG. 8. The Y-direction positioning member 116 is used to position the sub-frame 130 along the sub-scanning direction Y, namely the paper feeding direction, while being engaged with an engaging concave portion 139 provided on each of the supporting legs 131. The Z-direction positioning member 117 is employed to position the sub-frame 130along the upper/lower direction Z, while the lower edge of the supporting legs 131 is supported.

On the other hand, in this drawing, reference numeral 118 shows a supporting base for supporting overhang portions of the carriage guides 136 and 137. This supporting base 118 is made stood in an integral form at the outermost portion of the main frame 110 on the home position side. The supporting base 118 is arranged in such a manner that while the heights of the carriage guides 136 and 137 are adjusted by each of vertex faces of three projections 118*a* which are projected from a vertex portion of this supporting base 118, the supporting legs 138 provided on the home position side is supported from the lower side.

In this second embodiment with employment of the above-described arrangement, both the main frame 110 and the sub-frame 130, the predetermined portions of which are assembled with each other, can be correctly positioned and held in such a manner that after the sub-frame 130 is mounted on the main frame 110, the lower edges of the supporting legs 131 which are suspended on both edges of the sub-frames 130 are engaged with the respective positioning members 115, 116, 117 for the main scanning direction X, the sub-scanning direction Y, and the upper/lower direction Z, which are projected from both sides of the main frame 110.

Thus, the edge portions of the carriages 136 and 137 which are largely extended to the home position side by way of such an assembling manner can be correctly supported via the supporting legs 138 coupled to these carriage guides by the projection 118*a* on the supporting base 118 under such a condition that the gap is kept constant, while this supporting base 118 is made stood on the outermost side of the home position of the main frame 110. As a consequence, such a phenomenon that when the print head is moved to the home position, the carriage guides 136 and 137 are flexed downwardly by the own weight of this printer can be suppressed in advance.

Figure 9:
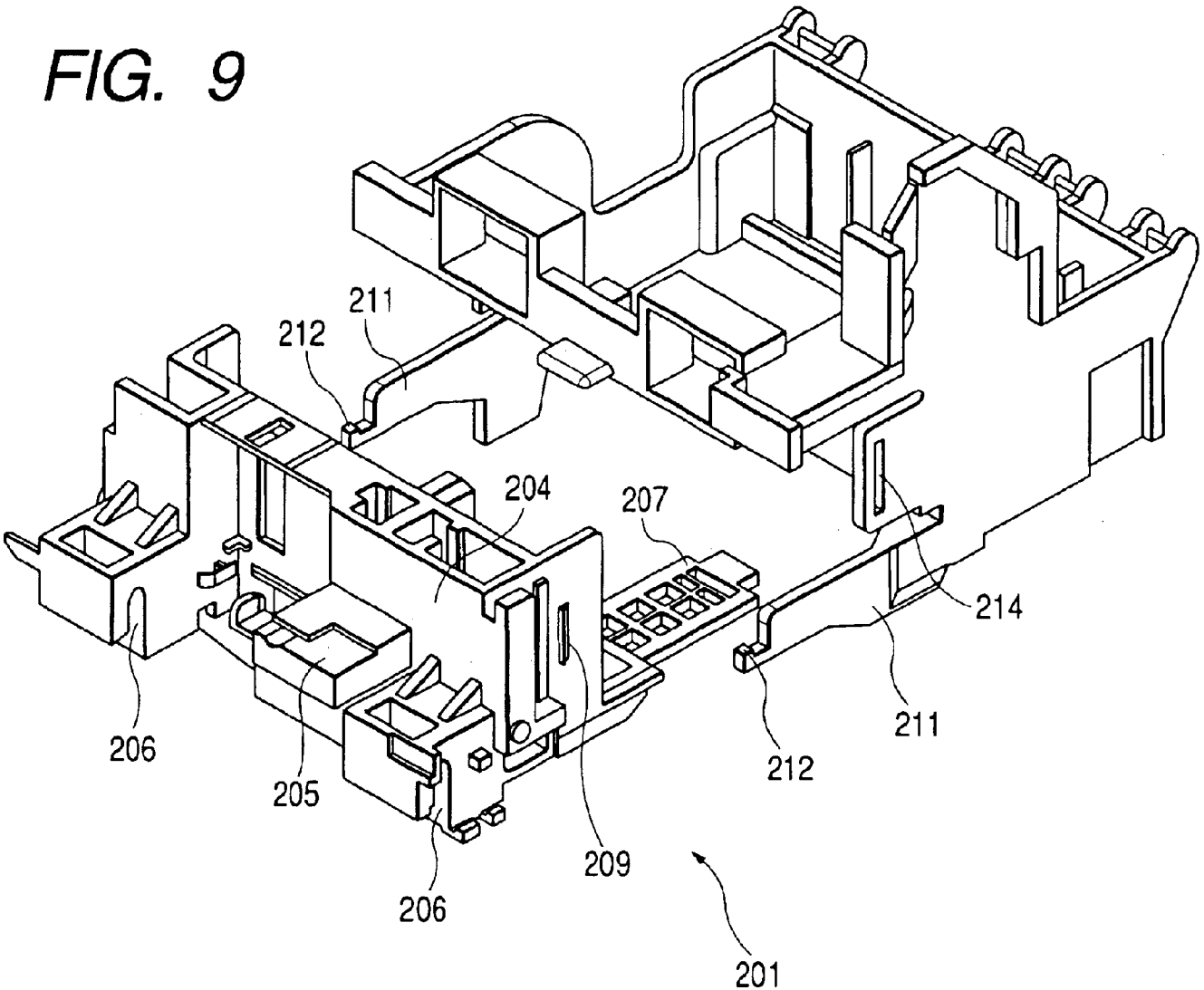
FIG. 9 is an exploded perspective view showing a head assembly according to a third embodiment of the present invention.
Figure 10:
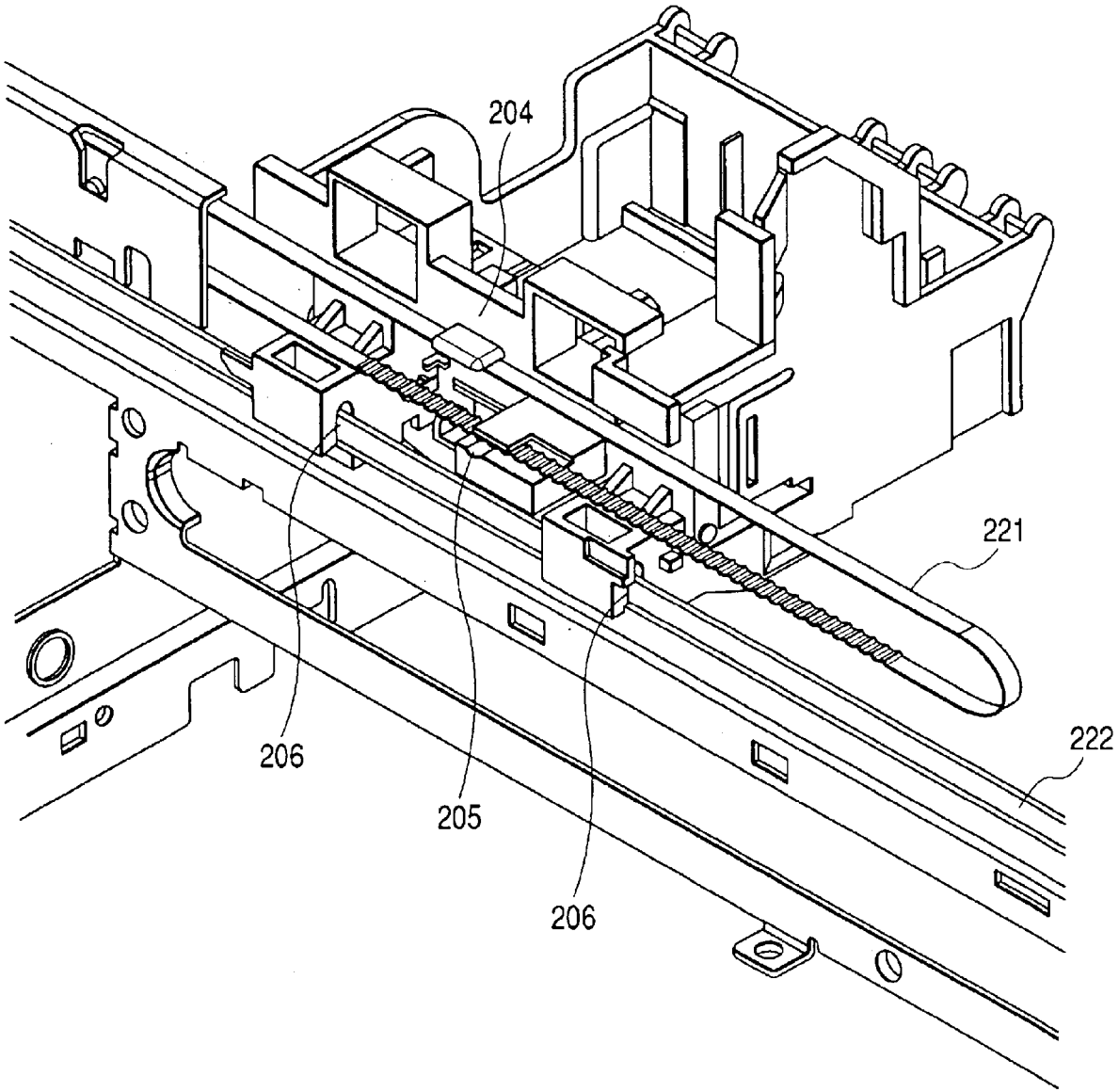
FIG. 10 is a perspective view showing such a condition under which the head assembly shown in FIG. 9 is assembled on a supporting structure of a printer.
Figure 11:
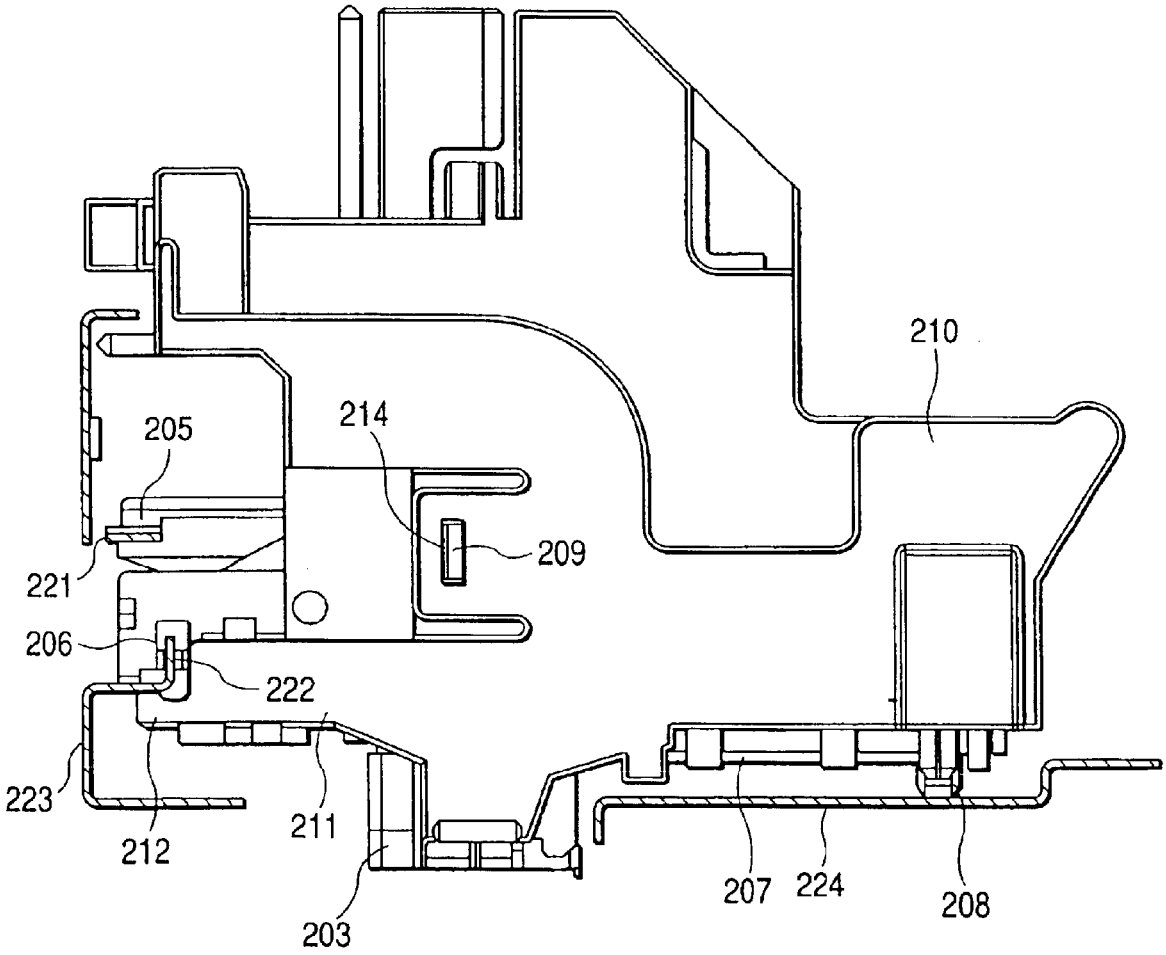
FIG. 11 is a side view showing such a condition under which the head assembly shown in FIG. 10 is assembled on the supporting structure of the printer.

Next, a third embodiment of the present invention will now be explained with reference to FIG. 9 to FIG. 11.

As indicated in these drawings, an ink jet recording print head 203 is mounted on a lower face of a head mounting portion 201 via a mounting portion. This head mounting portion 201 corresponds to such a portion of a head assembly of this third embodiment. Also, a cartridge mounting portion is provided together with an ink passage on an upright portion of this print head 203, while the cartridge mounting portion mounts an ink cartridge which stores thereinto both black ink and respective color ink constructed of yellow ink, magenta ink, and cyan ink.

A belt receiving portion 205 is formed at a nearly center portion of a front edge face 204 of this head mounting portion 201 in such a manner that this belt receiving portion 205 is projected from this nearly center portion, while an endless belt 221 used to trail this head mounting portion 201. Guided pieces (first guided portions) 206 are formed on both side edge portions of the front edge face 204 in such a manner that these guided pieces 206 whose sectional views are concave shapes directed downwardly are projected from these side edge portions, while the guided pieces (first guided portions) 206 slidably sandwich a main guide 222 along front/rear directions. The main guide 222 corresponds to such a first guide plate which is provided above a very close portion of a recording/writing portion of a printer main body, and is elongated along the main scanning direction.

Furthermore, a horizontally-elongated fitting piece 207 is formed on a rear portion of this head mounting portion 201 in such a manner that this fitting piece 207 is elongated from this rear portion. Then, a sliding projection piece (second guided portion) 208 is provided on a lower face of this fitting piece 207, while this sliding projection piece 208 is slid over a guide plate 224 corresponding to a second guide plate of the printer main body.

In this drawing, reference numeral 210 indicates a coupling frame which is coupled to the rear portion of the head mounting portion 201 in such a manner that the ink cartridge is surrounded by this coupling frame, and which forms the head assembly together with the head mounting portion 201. One pair of supporting legs 211 are horizontally elongated from both sides of this coupling frame 210. The paired supporting legs 211 are joined to this coupling frame 210 in an integral manner in such a manner that both sides of the head mounting portion 201 are gripped by these supporting legs 211. Furthermore, a guided portion 212 for regulating the main guide 222 between the guided portion 206 and the ewe guided portion 212 along the upper/lower directions is formed on tip edge portions of these supporting legs 211, while this guided portion 211 is inserted into such a guide plate 223 corresponding to a first guide plate having a crank-shaped cross section and which is equal to a lower half portion of the main guide 222.

It should also be noted that in this drawing, reference numeral 214 indicates coupling holes formed in the coupling frame 210, and the coupling holes 214 are coupled to coupling projections 209 which are provided on both sides of the head mounting portion 201.

In this third embodiment with employment of such a construction, when the head assembly which mounts thereon the print head 203 is assembled on the printer main body, the head mounting portion 201 is mounted in such a manner that the guided piece 206 of the head mounting portion 201 is ridden on the main guide 222 provided on the printer main body. Subsequently, the coupling frame 210 is fitted from the backward direction in such a manner that the bottom face is slid along the fitting piece 207 and also the supporting legs 211 of both sides are slid along both sides of the head mounting portion 201, and then, the main guide 222 is sandwiched between the guided piece 206 and the guided portions 212 of the tip portions of the supporting legs 211 along the upper/lower directions. As a consequence, while both the head mounting portion 201 and the coupling frame 210 sandwich the main guide 222, the head assembly of this third embodiment can be assembled.

Then, under this condition, when the endless belt 221 is fixed on the belt receiving portion 205 formed on the front edge faces, and this endless belt 221 is driven by a drive motor (not shown), while the head assembly which mounts thereon the print head 203 may be directly guided by both the main guide 222 and the guide plate 224, this head assembly may be trailed by-the endless belt 221, so that this head assembly can commence the correct travel along the main scanning direction "X."

While the ink jet printer has been explained as one example, the present invention may be applied to various sorts of printers. Also, while the coupling frame 210 is not employed, the head assembly may be alternatively constituted only by the head mounting portion 201 in such a way that the main guide 222 is sandwiched along the upper/lower directions.

Figure 12:
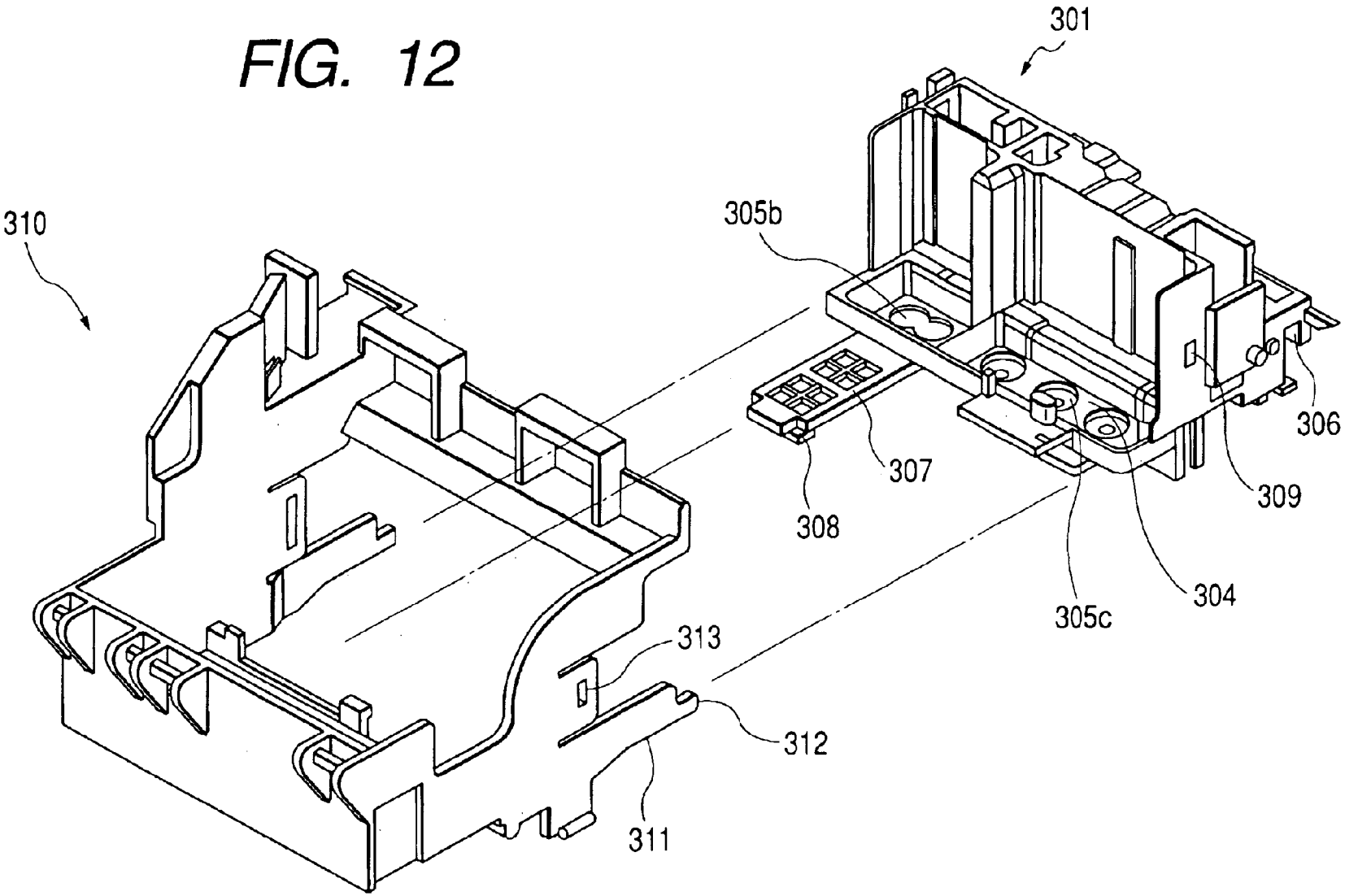
FIG. 12 is an exploded perspective view for showing a head assembly according to a fourth embodiment of the present invention.
Figure 13:
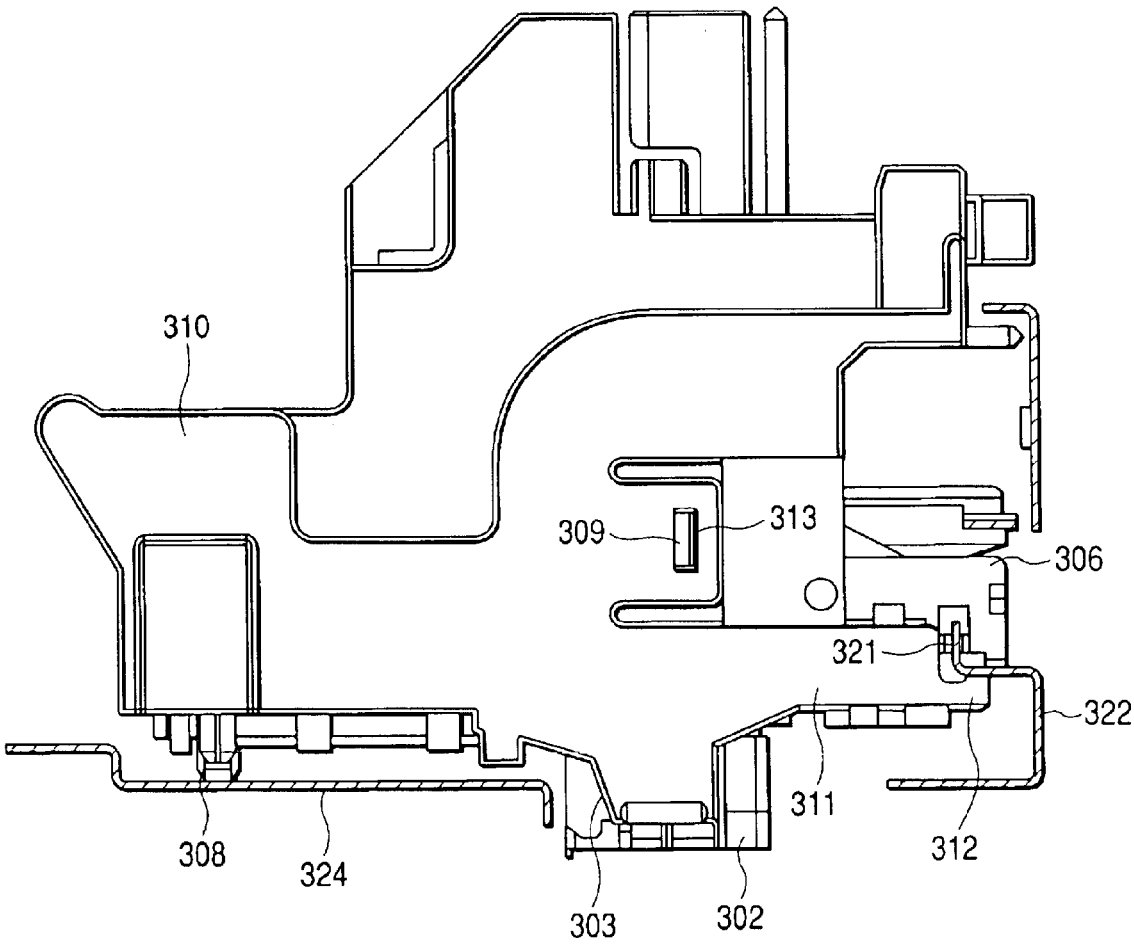
FIG. 13 is a perspective view showing such a condition under which the head assembly shown in FIG. 12 is assembled on a supporting structure of a printer.

Next, a fourth embodiment of the present invention will now be explained with reference to FIG. 12 and FIG. 13.

As indicated in these drawings, a mounting portion 303 used to mount an ink jet recording print head 302 is formed on a lower face of a head mounting portion 301 of a head assembly of this fourth embodiment. Also, a cartridge mounting portion 304 is provided on an upright portion of this print head 303, while the cartridge mounting portion 304 mounts an ink cartridge (not shown) which stores thereinto both black ink and respective color ink constructed of yellow ink, magenta ink, and cyan ink. Furthermore, a rear portion of the cartridge mounting portion 304 is arranged in such a manner that this rear portion is surrounded by a coupling frame 310 (will be explained later) which constitutes the head assembly with being coupled to the head mounting portion 301.

First guided portions having convex shapes directed to lower directions, namely guided portions 306 are provided on both sides of a front end portion of this head mounting portion 301. The guided portions 306 sandwich a main guide 321, namely a first guide plate from forward/backward directions, while this first guide plate is elongated along the main scanning direction, and is formed just above a recording section under raising condition. Also, a belt receiving portion used to fix thereon an endless belt (not shown) is provided at a center portion of this front edge face.

A fitting piece 307 which is fitted to the above-described coupling frame 310 is horizontally elongated on a rear end portion of this head mounting portion 301. A sliding-contact projection 308, namely a second guided portion is provided on a lower face of this tip portion with being projected therefrom. The sliding-contact projection 308 horizontally holds the head assembly, while this sliding-contact projection 308 is slidably contacted to a face of a guide plate 324 which is equal to a second guide plate. This second guide plate is suspended on a rear portion of the coupling frame 310 in parallel to the main scanning direction.

In this drawing, reference numeral 310 indicates a coupling frame which is coupled to a rear portion of the head mounting portion 301. One pair of supporting legs 311 are horizontally projected from both sides of this coupling frame 310. The paired supporting legs 311 are joined to this coupling frame 310 in an integral manner in such a manner that both sides of the head mounting portion 301 are gripped by these supporting legs 311. Furthermore, an upper-directed guide portion 312 for regulating the main guide 321 between the guided portion 306 and the own guide portion 312 along the upper/lower directions is formed on tip edge portions of these supporting legs 311, while this upper-directed guide portion 312 is inserted into such a carriage guide plate 322 having a crank-shaped cross section and which is fixed on a lower portion of the main guide 321.

It should also be understood that in the drawings, reference numerals 305*b* and 305*c* show ink through-holes communicated to the print head 302. Also, reference numeral 313 shows engaging holes formed in engaging projections 309 which are provided on both sides of the head mounting portion 301.

In this fourth embodiment with employment of such a construction, when the head assembly which mounts thereon the print head 302 is assembled on the printer main body, the head mounting portion 301 is firstly mounted in such a manner that the guided portion 306 is ridden on the main guide 321 formed under raise condition, and this head mounting portion 301 is mounted above the recording section. In addition, under this condition, the coupling frame 310 is horizontally pushed from the rear direction of the head mounting portion 301 so as to form the head structural body in such a manner that the bottom face of the coupling frame 310 is slid along the fitting piece 307 of the head mounting portion 301 and also the supporting legs 311 of both sides are slid along both sides of the head mounting portion 301.

As a result, at a pushed rear end of the coupling frame 310, the tip portions of the supporting legs 311 is entered into the crank-shaped concave portions of the guide plate 322 which is fixed on the lower portion of the main guide 321, and then, regulates the main guide 321 between the guided portion 306 and the own tip portion along the upper/lower directions, so that the head assembly is coupled to the main guide 321 in an integral manner. As a consequence, the head assembly can be traveled along the main scanning direction, while the front end of this head assembly is guided by the main guide 321, and the rear end thereof is guided by the guide plate 324.

As a consequence, finally, when the endless belt coupled to the head assembly is trailed by a drive motor (not shown), the head assembly can commence the correct travel along the main scanning direction, while this head assembly is guided by these main guide 321 and guide plate 324.

It should also be understood that when the head assembly is required to be dismounted from the printer main body due to a certain reason, after both the coupling hole 313 and the coupling projection 309 are dismounted, the coupling frame 310 is slid backwardly. As a result, the head mounting portion 301 of the head structural body may be dismounted from the main guide 321.

While the ink jet print heads have been explained as the example in the foregoing descriptions, the present invention may be apparently applied to a thermal type print head, and/or a wire impact type print head.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A printer, in which printing is performed on a recording medium which is transported in a first direction, comprising:

a carriage, reciprocately moved in a second direction which is perpendicular to the first direction;

a print head, mounted on the carriage, the print head having a head face;

a first frame, placed on a first side of the print head; and a first guide plate, extending in the second direction, which includes:

a first portion, provided as a part of the first frame so as to extend in a third direction which is orthogonal to both of the first direction and the direction;

a second portion, continued from the first portion so as to extend in the first direction, the second portion supporting the carriage so as to define a distance between the head face and the recording medium; and a third portion, continued from the second portion so as to extend in a fourth direction opposite to the third direction, wherein the carriage has a pair of supporting portions between which the second portion is interposed.

2. The printer as set forth in claim 1, wherein the carriage is provided with a first guide member which is slid on a first face of the second portion of the first guide plate when the carriage moves in the second direction.

3. The printer as set forth in claim 2, wherein the first guide member is slid on a line situated substantially at a center of the second portion of the first guide plate in the first direction.

4. The printer as set forth in claim 1, wherein either one of the first portion and the third portion of the first guide plate defines a position of the carriage in the first direction.

5. The printer as set forth in claim 4, wherein the carriage is provided with a second guide member which grips either one of the first portion and the third portion of the first guide plate, so that the second guide member is slid thereon when the carriage moves in the second direction.

6. The printer as set forth in claim 1, wherein:

the carriage is provided with a third guide member which is slid on a second face of the second portion of the first guide plate when the carriage moves in the second direction; and the second face is an opposite face of the first face.

7. The printer as set forth in claim 1, further comprising:

a second frame, placed on a second side of the print head which is opposite to the first side;

a second guide plate, extending in the second direction, which includes:

a fourth portion, provided as a part of the second frame so as to extend in the third direction;

a fifth portion, continued from the fourth portion so as to extend in the first direction, the fifth portion supporting the carriage so as to define the distance between the head face and the recording medium; and a sixth portion, continued from the fifth portion so as to extend in the fourth direction.

8. The printer as set forth in claim 7, wherein the carriage is provided with a fourth guide member which is slid on the fifth portion of the second guide plate when the carriage moves in the second direction.

9. The printer as set forth in claim 1, wherein the supporting portions of the carriage grips the second portion of the first guide plate.

10. The printer as set forth in claim 1, wherein one of the supporting portions slides on a first face of the second portion; and wherein another of the supporting portions slides on a second face of the second portion, the second face being opposite to the first face.

11. A printer, in which printing is performed on a recording medium which is transported in a first direction, comprising:

a carriage, on which a print head is mounted, reciprocately moved in a second direction which is perpendicular to the first direction;

a recording region, in which the print head performs printing;

a home position, provided in one of both sides of the recording region in the second direction, at which the carriage is placed when the print head does not perform printing;

a first frame, including:

a carriage guide, extending in the second direction from the recording region to the home position such that the carriage moves therealong; and supporting legs, extending downwards from both side end portions of the carriage guide; and a second frame, including:

first positioning members, which define positions of the supporting legs in the first direction;

second positioning members, which define positions of the supporting legs in the second direction;

third positioning members, which define positions of the supporting legs in a third direction which is orthogonal to both of the first direction and the second direction; and a supporting base, which supports at least a bottom portion of one supporting leg situated in the home position.

12. A printer, in which printing is performed on a recording medium which is transported in a first direction, comprising:

a first flat guide plate, extending in a second direction which is perpendicular to the first direction;

a looped belt member;

a drive motor, which circulates the looped belt member in the second direction;

a drive motor, which circulates the looped belt member in the second direction;

a head assembly, including:

a print head;

a belt holder, at which a part of the looped belt is fixed; and a first guided portion, provided in a first side of the print head, and slid on the first flat guide plate in accordance with the circulation of the looped belt member.

13. The printer as set forth in claim 12, further comprising a second guide plate placed on a second side of the print head, which is an opposite to the first side, so as to extend in the second direction, wherein the head assembly includes a second guided portion slid on the second guide plate in accordance with the circulation of the looped belt member.

14. The printer as set forth in claim 12, wherein:

the first guided portion is slidably held on the first guide plate while defining a position of the print head in the first direction; and the head assembly includes a third guided portion slidably held on the first guide plate while defining a position of the print head in a third direction which is orthogonal to both of the first direction and the second direction.

* * * * *